US007121831B2

(12) United States Patent
Hojo et al.

(10) Patent No.: US 7,121,831 B2
(45) Date of Patent: Oct. 17, 2006

(54) BALANCE PRACTICING MACHINE

(75) Inventors: Hiroyuki Hojo, Hikone (JP); Ryusuke Nakanishi, Nagoya (JP)

(73) Assignee: Matsushita Electric Works, Ltd., Osaka (JP)

( * ) Notice: Subject to any disclaimer, the term of this patent is extended or adjusted under 35 U.S.C. 154(b) by 39 days.

(21) Appl. No.: 10/757,850

(22) Filed: Jan. 16, 2004

(65) Prior Publication Data

US 2004/0198553 A1 Oct. 7, 2004

(30) Foreign Application Priority Data

Jan. 17, 2003 (JP) ..... 2003-010290

(51) Int. Cl.
*A63B 69/04* (2006.01)

(52) U.S. Cl. ..... 434/247; 472/97

(58) Field of Classification Search ..... 472/59–61, 472/95–99; 434/55, 247
See application file for complete search history.

(56) References Cited

U.S. PATENT DOCUMENTS

| | | | | |
|---|---|---|---|---|
| 2,889,148 | A * | 6/1959 | Lyles | 472/97 |
| 5,429,515 | A * | 7/1995 | Greenwood | 434/247 |
| 6,059,666 | A * | 5/2000 | Ohara et al. | 472/97 |
| 6,402,626 | B1 * | 6/2002 | Beaty | 472/96 |
| 2002/0115536 | A1 | 8/2002 | Hojo et al. | |

FOREIGN PATENT DOCUMENTS

| | | |
|---|---|---|
| CN | 2246625 | 8/1997 |
| DE | 19909613 | 9/2000 |
| EP | 0963767 | 12/1999 |
| JP | 6-65350 | 8/1994 |
| JP | 2001-286578 | 10/2001 |
| WO | 97/29815 | 8/1997 |
| WO | 98/32501 | 7/1998 |

OTHER PUBLICATIONS

English Language Abstract of EP 0963767.
English Language Abstract of WO 98/32501.

* cited by examiner

*Primary Examiner*—Kien Nguyen
(74) *Attorney, Agent, or Firm*—Greenblum & Bernstein, P.L.C.

(57) ABSTRACT

A balance practicing machine that offers simplified control, reduced cost, and a compact drive assembly that reduces the space requirement for the machine. The machine includes an output shaft from one side of a power source to impart three movements to the seat in the form of a repetitive linear motion in the longitudinal direction, a repetitive pivoting motion around a longitudinal shaft, and a repetitive pivoting motion around transverse shafts. A seat base is connected to an active frame, through connector links, so as to provide swinging movement of the seat base around transverse shafts. The active frame is connected to a base member so as to allow the repetitive pivoting movement of the active frame around a longitudinal shaft.

17 Claims, 9 Drawing Sheets

BALANCE PRACTICING MACHINE

BACKGROUND OF THE INVENTION

1. Field of Application

The invention relates to a balance practicing machine that provides a swinging motion to a person sitting on the machine in order to provide balance practice and exercise.

2. Description of the Related Art

The related art includes a type of conventional balance practicing machine which is constructed in the shape of a horse and equipped with six power sources that generate six different movements. An example of such a conventional balance practicing machine is described in Japanese Kokou Patent No. H6-65350. These six movements consist of repetitive linear motions in the fore-aft, right-left, and vertical directions, and repetitive pivoting motions around longitudinally, transversely, and vertically oriented shafts. These motions combine to form a compound swinging movement comprised of six separately controllable movements.

Another type of conventional balance practicing machine is shown in FIGS. 7 through 9. An example of this type of conventional balance practicing machine is described in Japanese Kokai (laid open) Patent 2001-286578. This machine is equipped with seat 2 on which a person sits, drive assembly 3 which imparts a swinging motion to seat 2, main shaft 30 of motor 10*a* that extends in the 'A' and 'B' directions, and output shafts 12*a* and 12*b* that provide power transmission to move seat 2 with a repetitive linear motion in the fore-aft X direction, a repetitive pivoting motion in a direction around transversely oriented shaft 7, and a repetitive pivoting motion in a direction around longitudinally oriented shaft 9. As FIG. 7 illustrates, torque supplied through output shaft 12*a*, which extends from one side of motor 10*a*, is transferred from gear 31 to gear 32, and rotates shaft 33 to which first crank 34 is attached to one end thereof. The rotation of first crank 34 is converted, through first rod 35, into concurrent forward and rearward pivoting motions of first link 36 and second link 38 around pivot pins 37 and 39, respectively, thus imparting forward and rearward motions to seat 2, through seat base 4, along with changes in the inclination of the upper surface of seat 2. The upper end of second link 38 is pivotably attached to seat base 4 through ball joint 71 so as to form a movable link there between, and the lower end is pivotably attached to base member 8 through support plate 70. The torque supplied by output shaft 12*b*, which extends from the other side of motor 10*a*, is transferred from gear 40 to gear 41 (FIG. 8) to rotate second crank 43 which is connected to one end of shaft 42 (FIG. 9). The rotation of second crank 43 imparts a repetitive pivoting motion to seat base 4 and seat 2, through second rod 44, in a direction around longitudinally oriented shaft 9.

Because the balance practicing machine described in Japanese Kokou Patent No. H6-65350 is equipped with six separately controlled power sources, the timing, speed, and operating range of each power source must be individually controlled, thus making for an extremely complex control system. Moreover, the use of six power sources increases both the cost and size of the balance practicing machine.

The balance practicing machine described in Japanese Kokai (laid open) Patent 2001-286578 incorporates output shaft 12 that extends in two opposing directions from motor 10*a*, thus requiring that motor 10*a* be installed horizontally. This structure creates a problem in that a large amount of space must be provided on the horizontal plane to accommodate the bi-direction extension of output shaft 12, and that drive assembly 3 be made to relatively large dimensions.

SUMMARY OF THE INVENTION

The invention, improving on the two conventional structures described above, proposes a balance practicing machine that employs a power source from which a rotating output shaft extends from one side, and that generates movements of the seat in the form of a repetitive linear motion in the fore-aft direction, a repetitive pivoting motion around a longitudinal shaft, and a repetitive pivoting motion around transverse shafts. The invention is thus able to offer the advantages of a simple control system, reduced cost, and a smaller balance practicing machine that requires less space for the drive assembly.

In order to improve the devices of the prior art, the present invention proposes a balance practicing machine comprising a seat on which a person sits, and a drive assembly that imparts a swinging motion to the seat. A seat base, to which the seat is fixedly attached, is pivotably supported, through connector links, by transverse shafts on an active frame so as to allow a repetitive pivoting movement of the seat base around transverse shafts. The active frame is pivotably supported by a longitudinal shaft on a base member so as to allow the repetitive pivoting movement of the active frame around the longitudinal shaft.

The drive assembly is equipped with a power source from which an output shaft extends from one side, and a transmission which converts the rotational torque from the output shaft into three movements of the seat base, thus imparting to the seat a repetitive linear motion in the fore-aft X direction, a repetitive pivoting motion around the transverse shafts, and a repetitive pivoting motion around the longitudinal shaft.

This construction is thus able to provide a body balancing practice and exercise function by moving the seat with fore-aft, left-right, and vertical swinging motions as three movements that include a repetitive linear motion in the fore-aft X direction, a repetitive pivoting motion around the transverse shafts, and a repetitive pivoting motion around the longitudinal shaft.

Moreover, the use of only one power source eliminates the need for multiple power sources, and because the output shaft extends from only one side of the power source, the drive assembly can be made to more compact dimensions and installed within a smaller space as compared to that required by a conventional drive assembly.

The transmission includes a first sub-transmission that generates a repetitive linear motion in the fore-aft X direction as well as a repetitive pivoting motion around the transverse shafts. The first sub-transmission includes a first shaft which is rotatably supported by the seat base and connected to the output shaft through a first gear, an eccentric crank which is eccentrically connected to one end of the first shaft, and an arm link of which one end is connected to an eccentric crank and the other end to a connector link.

The transmission also includes a second sub-transmission that generates a repetitive pivoting motion around the longitudinal shaft. The second sub-transmission includes a second shaft which is rotatably supported by the seat base and connected to the first shaft through a second gear, and an eccentric rod of which one end is eccentrically connected to one end of the second shaft, and the other end pivotably connected to the base member.

The first and second sub-transmissions offer the advantages of few required components, easy assembly, and reduced size.

An aspect of the present invention provides a balance practicing machine having a seat and a drive assembly that imparts a swinging motion in a longitudinal direction to the seat, the balance practicing machine including a seat base attached to the seat; a plurality of transverse shafts provided on an active frame; a plurality of connector links, each connector link pivotable on one of the transverse shafts and on the seat base so as to provide swinging motion to the seat base around the transverse shafts; a longitudinal shaft provided on a base member and pivotably supporting the active frame so as to provide a pivoting motion to the active frame around the longitudinal shaft; an output shaft provided in the drive assembly that extends from one side of a power source; and a transmission that converts torque from the output shaft into three movements of the seat through the seat base, in the form of a linear motion in a longitudinal direction, a pivoting motion around the transverse shafts, and a pivoting motion around the longitudinal shaft. According to a further aspect of the present invention, the transmission includes a first sub-transmission that generates a linear motion in the longitudinal direction and a pivoting motion around the transverse shafts, the first sub-transmission including a first shaft rotatably supported and connected to the output shaft through a first gear, an eccentric crank eccentrically connected on one end of the first shaft, and an arm link having one end connected to the eccentric crank and the other end to a connector link; and a second sub-transmission that generates a pivoting motion around the longitudinal shaft, the second sub-transmission including a second shaft rotatably supported and connected to the first shaft through a second gear, and an eccentric rod having one end eccentrically connected to one end of the second shaft and the other end pivotably connected to the base member. Further, the plurality of connector links may include a pair of connector links including a first connector link pivotable on a forward transverse shaft and a second connector link pivotable on a rearward transverse shaft. The first connector link and the second connector link may be provided in positions nonparallel to each other, so that swinging motion in the longitudinal direction is imparted to the seat base; and the pair of connector links, the seat base, and the base member substantially form a trapezoid. The drive assembly may be housed substantially within the seat. The seat base may move forwardly and rearwardly in the longitudinal direction so that the seat base is intermittently parallel and nonparallel to the base member during the swinging motion of the seat base.

A further aspect of the present invention provides a balance practicing machine having a seat that supports an operator, the balance practicing machine including a pedestal supporting the seat on top of the pedestal; and a drive assembly that provides a swinging motion in a first direction to the seat and a pivoting motion in a second transverse direction to the seat; wherein the drive assembly is housed substantially within the seat. Further, the seat may be substantially shaped like a saddle. According to a further aspect of the invention, the drive assembly includes a pair of connector links including a first connector link pivotable on a forward transverse shaft and a second connector link pivotable on a rearward transverse shaft. Further, the first connector link and the second connector link may be provided in positions nonparallel to each other, so that swinging motion in the longitudinal direction is imparted to the seat base; the pair of connector links, a seat base, and a base member may substantially form a trapezoid; and the seat base moves forwardly and rearwardly in the longitudinal direction so that the seat base is intermittently parallel and nonparallel to the base member during the swinging motion of the seat base.

A further aspect of the present invention provides a balance practicing machine having a seat and a drive assembly that imparts a swinging motion in a longitudinal direction to the seat, the balance practicing machine including a seat base attached to the seat; a plurality of transverse shafts provided on an active frame; a plurality of connector links, each the connector link pivotable on one of the transverse shafts and on the seat base so as to provide swinging motion to the seat base around the transverse shafts; a longitudinal shaft provided on a base member and pivotably supporting the active frame so as to provide a pivoting motion to the active frame around the longitudinal shaft; a single power source; and a transmission that converts torque from the single power source into three movements of the seat through the seat base, in the form of a linear motion in a longitudinal direction, a pivoting motion around the transverse shafts, and a pivoting motion around the longitudinal shaft. Further, the single power source may include an output shaft provided in the drive assembly that extends from one side of the single power source; wherein the transmission converts torque from the output shaft into the three movements of the seat through the seat base, in the form of a linear motion in a longitudinal direction, a pivoting motion around the transverse shafts, and a pivoting motion around the longitudinal shaft.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which.

DETAILED DESCRIPTION OF THE INVENTION

Figure 1:
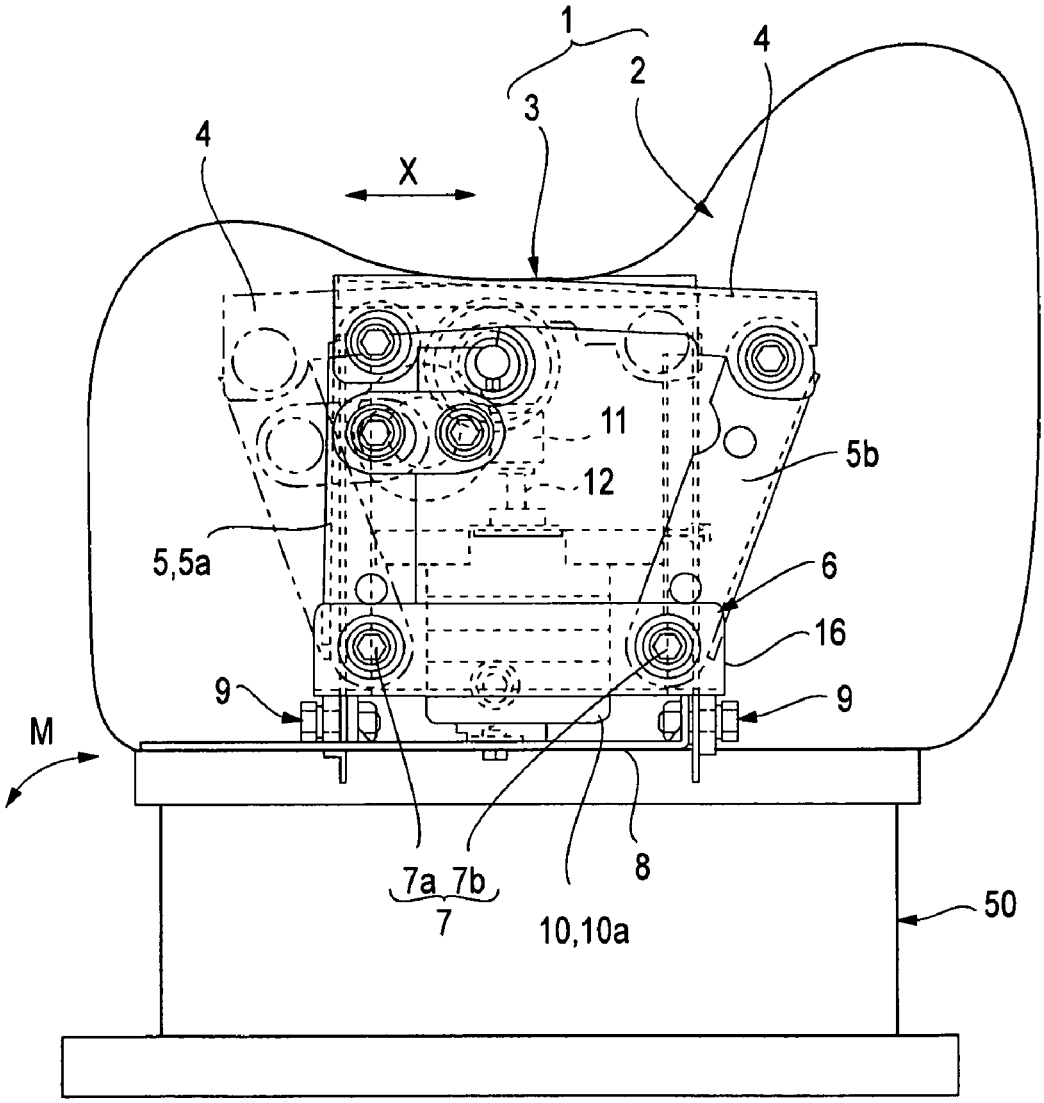
FIG. 1 is a side view of the balance practicing machine according to an embodiment of the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The following will explain an embodiment of the present invention with reference to the attached figures. The present invention includes a balance practicing machine 1 which, as shown in FIGS. 1 through 4, is constructed in the form of a seat 2 on which a persons sits, a pedestal 50 which supports the seat 2, and a drive assembly 3 that imparts a swinging motion to the seat 2.

Figure 2:
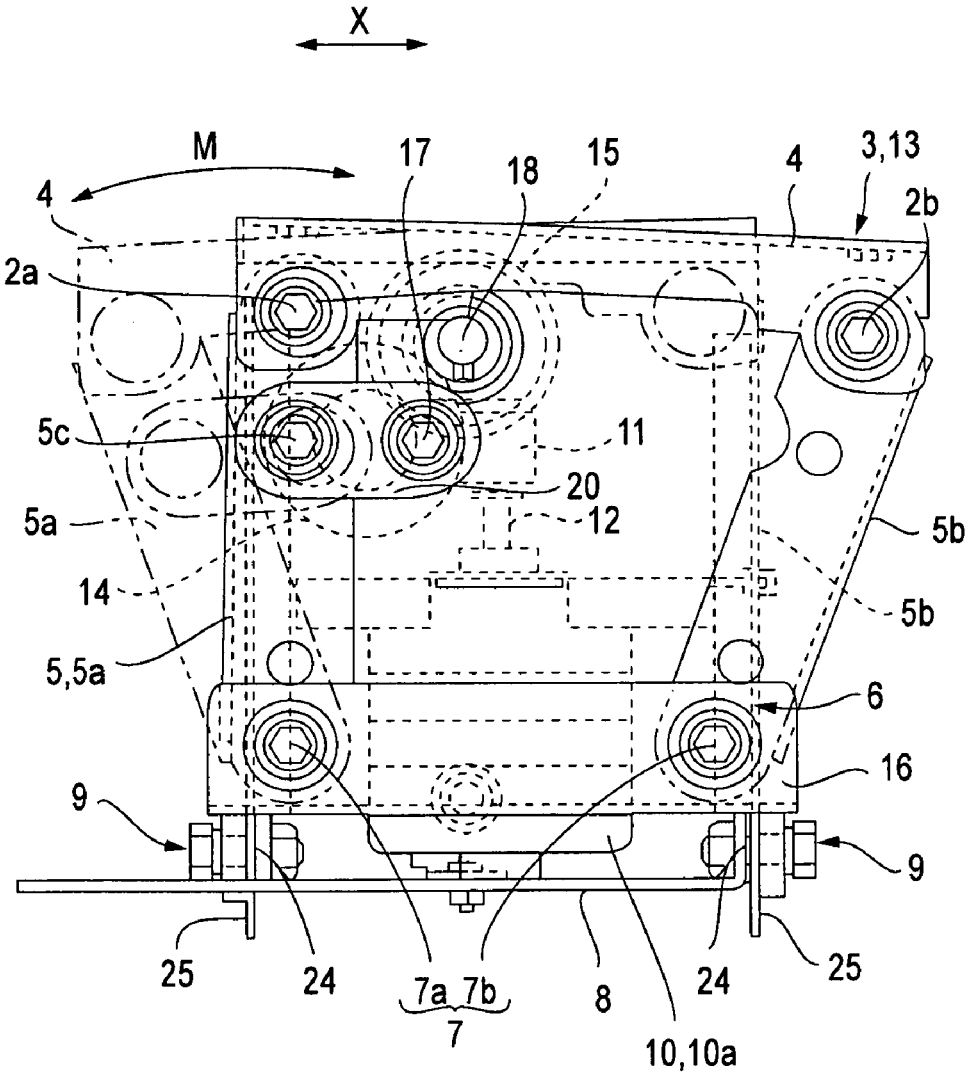
FIG. 2 is an enlarged side view illustrating the manner in which the seat of the balance practicing machine of the embodiment of FIG. 1 view moves with a repetitive linear motion in the longitudinal direction and a repetitive pivoting motion around the transverse shafts.

As shown in FIG. 2, seat base 4, which is fixedly attached to the lower surface of seat 2, is supported by active frame 6, through a pair of left and right side connector links 5 in a manner that allows seat base 4 to swing in the fore-aft or longitudinal direction with respect to active frame 6. Active frame 6 is supported by base member 8 so as to be pivotable to the right and left thereon, and transmission 13 is provided between seat 2 and active frame 6. The pair of right and left connector links 5 each include a front link 5*a* and rear link 5*b*. The upper ends of front links 5*a* are pivotably attached to the front edge of seat base 4 through upper pivot pins 2*a*, and the lower ends of front links 5*a* are pivotably attached to the front edge of side plate 16 of active frame 6 through lower pivot pins 7*a*. The upper ends of rear links 5*b* are pivotably attached to the rear edge of seat base 4 through upper pivot pins 2*b*, and the lower ends are pivotably attached to the rear edge of side plate 16 of active frame 6 through lower pivot pins 7*b*. Lower front and rear pivot pins 7*a* and 7*b* are each part of front and rear transverse shafts 7 that support the pivoting movement of connector links 5 around the transverse axes or shafts 7, which extend in the left and right Y direction. FIG. 2 shows a first position of the seat base 4 in solid lines (the right position in FIG. 2) and a second position of the seat base 4 in dotted lines (the left position in FIG. 2). As shown in FIG. 2, each pair of connector links 5*a*, 5*b* are not parallel to each other. That is, connector link 5*a* is not parallel to connector link 5*b*. As a result, a repetitive swinging motion (i.e., linear motion combined with pivoting motion) is obtained in the form of seat base 4 swinging around transverse shafts 7 in the M direction shown in FIG. 2. Additionally, as shown in FIG. 2, the swinging motion of the base 4 around the transverse shafts 7 provides movement of the seat base 4 such that the seat base 4 does not remain parallel to the base member 8.

Figure 4:
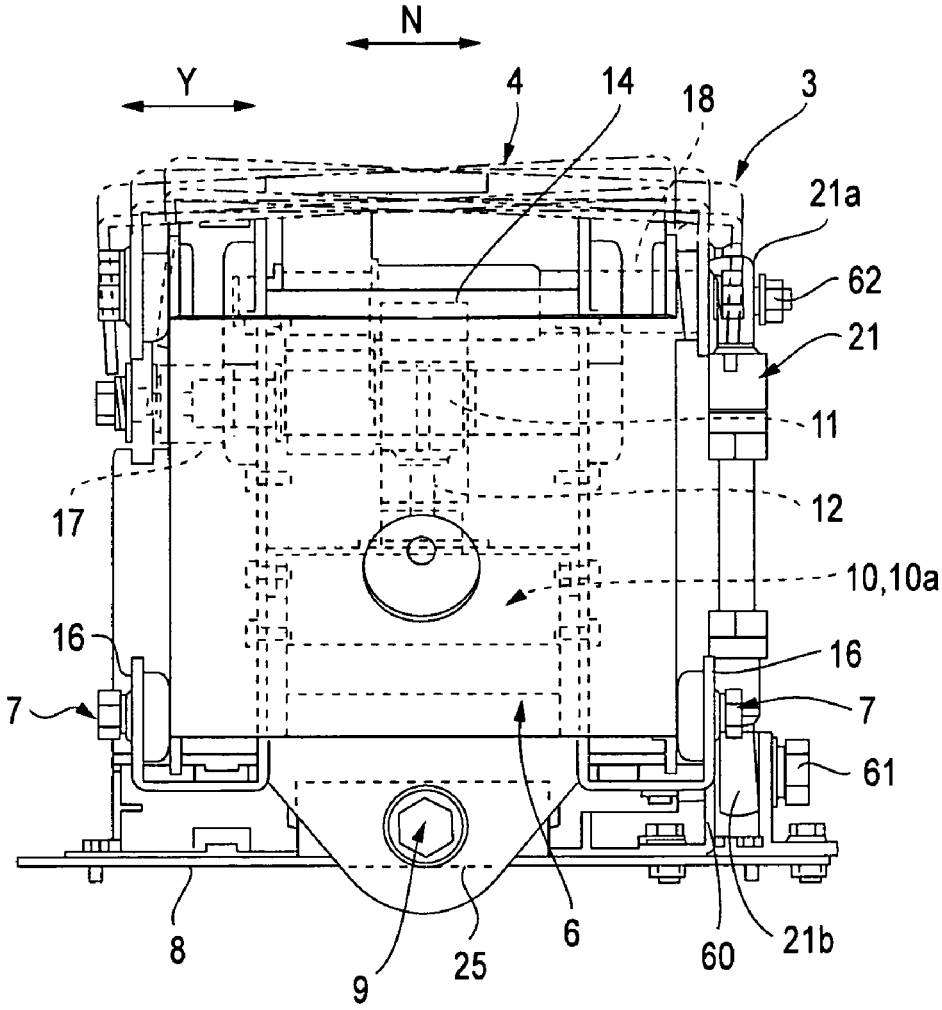
FIG. 4 is an enlarged front view illustrating the manner in which the seat pivots around the longitudinal shaft of the balance practicing machine of the embodiment of FIG. 1.

As illustrated in FIGS. 2 and 4, pivot support plates 24 are located at the front end and rear end of base member 8 and disposed along the longitudinal X direction. Connector plates 25 are provided as vertical members of the front end and rear end portions of active frame 6, align along the longitudinal X direction in opposition to pivot support plates 24, and are pivotably joined to longitudinal shaft 9 so as to be able to pivot against support plates 24. The front and rear ends of active frame 6 are pivotably supported along the center of base member 8 by longitudinal shaft 9, thereby allowing seat base 4 to repetitively pivot around longitudinal shaft 9 in direction N as shown in FIG. 4.

Drive assembly 3 incorporates power source 10 in the form of a single motor 10*a* from which output shaft 12 extends outward from one side, and transmission 13 that converts the rotational torque from output shaft 12 into three movements of seat 2 through seat base 4. The movements of the seat include (1) a repetitive fore-aft longitudinal linear motion along the X direction; (2) a repetitive pivoting motion around transverse shafts 7; and (3) a repetitive pivoting motion around longitudinal shaft 9. Together, the (1) repetitive fore-aft longitudinal linear motion along the X direction plus the (2) repetitive pivoting motion around transverse shafts 7 provide the fore-aft longitudinal swinging motion of the present invention. The fore-aft longitudinal swinging motion of the present invention is a mixed motion formed by linear motion combined with pivoting motion. In this embodiment, motor 10*a* is provided vertically on base member 8 with output shaft 12 extending in the upward direction.

Figure 3:
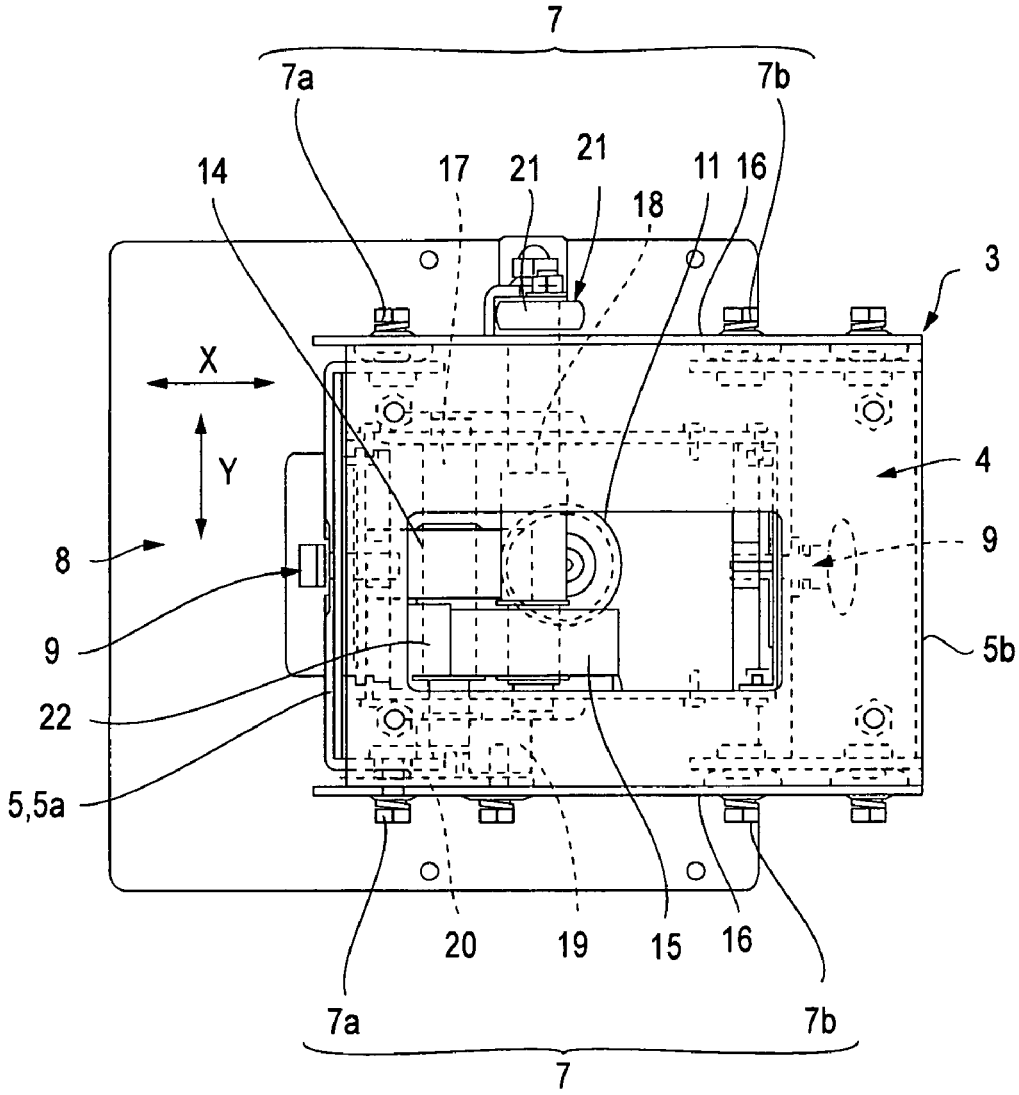
FIG. 3 is a top view of the drive assembly of the balance practicing machine of the embodiment of FIG. 1.
Figure 6:
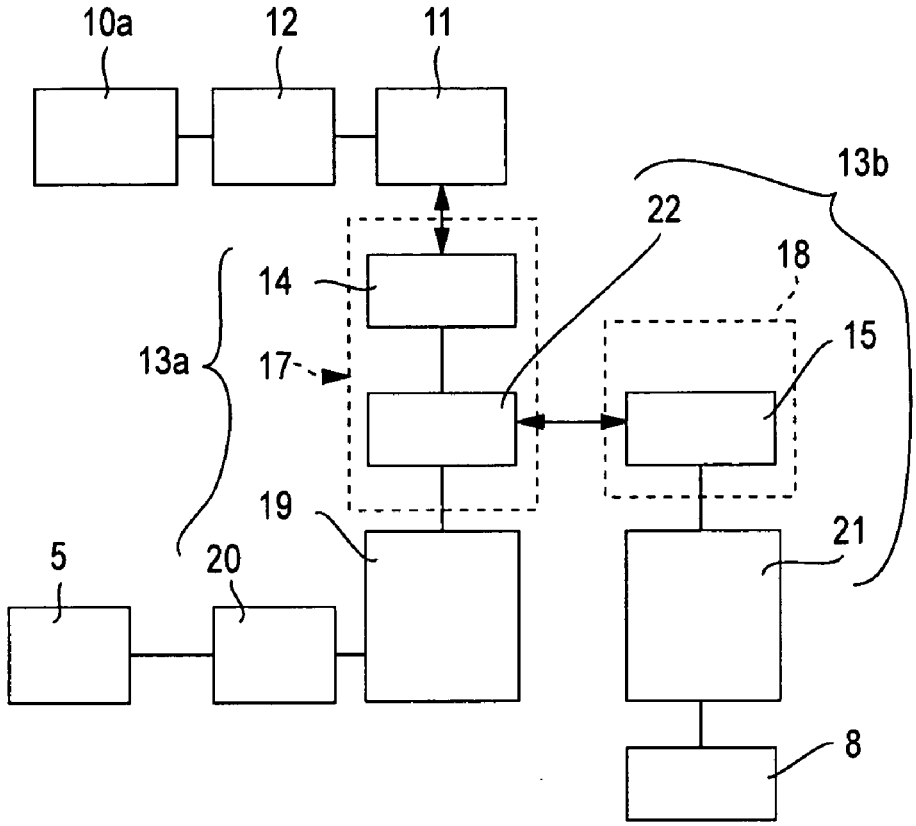
FIG. 6 is a block diagram of the drive assembly of the balance practicing machine of the embodiment of FIG. 1.

Transmission 13 is constructed in the form of first sub-transmission 13*a* that generates the repetitive linear motion in the fore-aft longitudinal X direction and the repetitive pivoting motion around transverse shafts 7, and second sub-transmission 13*b* that generates the repetitive pivoting motion around longitudinal shaft 9. As shown in FIGS. 2, 3, and 6, first sub-transmission 13*a* includes first shaft 17 that is joined to output shaft 12 through first gear 14, eccentric crank 19 connected to an eccentric point on one end of first shaft 17, and arm link 20 of which one end is connected to pivot pin 5*c* on connector link 5*a*, and the other to eccentric crank 19. Each end of first shaft 17 is rotatably supported by the machine. The eccentric rotation of eccentric crank 19, relative to the rotation of first shaft 17, imparts a repetitive movement to front link 5*a*, through arm link 20, along the fore-aft longitudinal X direction. This movement is transferred to seat base 4, thus driving seat 2 with a repetitive swinging motion in the direction indicated by arrow M in FIGS. 1 and 2.

Second sub-transmission 13*b*, as shown in FIGS. 3, 4, and 6, includes second shaft 18 that is connected to first shaft 17 through second gear 15, and eccentric rod 21 of which one end is eccentrically joined to one end of second shaft 18, and the other end pivotably joined to base member 8. Both ends of second shaft 18 are rotatably supported by the machine. Eccentric rod 21 may be located on either the right or left side of seat base 4 with upper end 21*a* eccentrically joined to one end of second shaft 18 through pivot pin 62 as shown in FIG. 4, and lower end 21*b* pivotably joined to pivot pin 61 which is anchored by L-shaped connecting bracket 60 which is, in turn, fixedly attached to base member 8. The rotation of second shaft 18 imparts an eccentric rotational movement to the upper end of eccentric rod 21, thus conveying a swinging motion to seat 2, through seat base 4, in the direction of arrow N shown in FIG. 4.

A structure is thus formed whereby the rotation of output shaft 12, which extends from one side of motor 10*a*, rotationally drives first shaft 17 through the meshing of motor worm gear 11 with first gear 14, and second shaft 18 through the meshing of drive gear 22 (on first shaft 17) with second gear 15. Eccentric crank 19, which is provided on one end of first shaft 17, rotates along an eccentric orbit powered by the rotation of first shaft 17, thereby imparting a longitudinal pivoting motion in the X direction, through arm link 20, to front link 5*a* around front transverse shaft 7*a*. At the same time, rear link 5*b* pivots with the same motion around rear transverse shaft 7*b*, thus imparting a repetitive longitudinal swinging motion to seat 2, through seat base 4, in the M direction. Moreover, the rotation of second shaft 18 drives the top end of eccentric rod 21 through an eccentric orbit that imparts a repetitive pivoting motion to seat 2, through seat base 4, around longitudinal shaft 9.

Figure 5A:
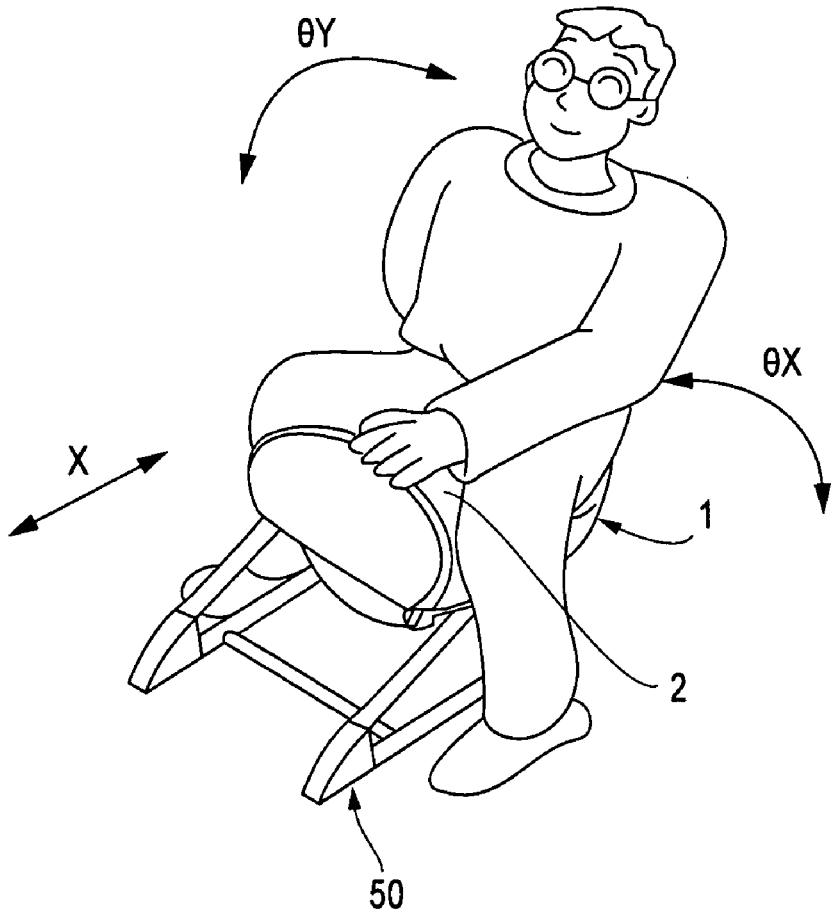
FIG. 5*a* is a perspective view of the balance practicing machine of the embodiment of FIG. 1 in use.
Figure 5B:
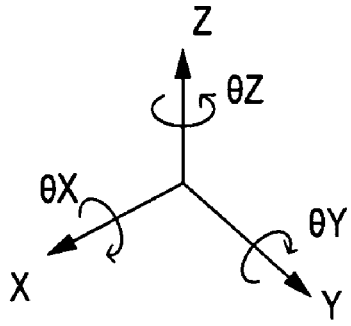
FIG. 5*b* is a diagram illustrating the linear and swinging movements of the seat of the balance practicing machine of the embodiment of FIG. 1.
Figure 7:
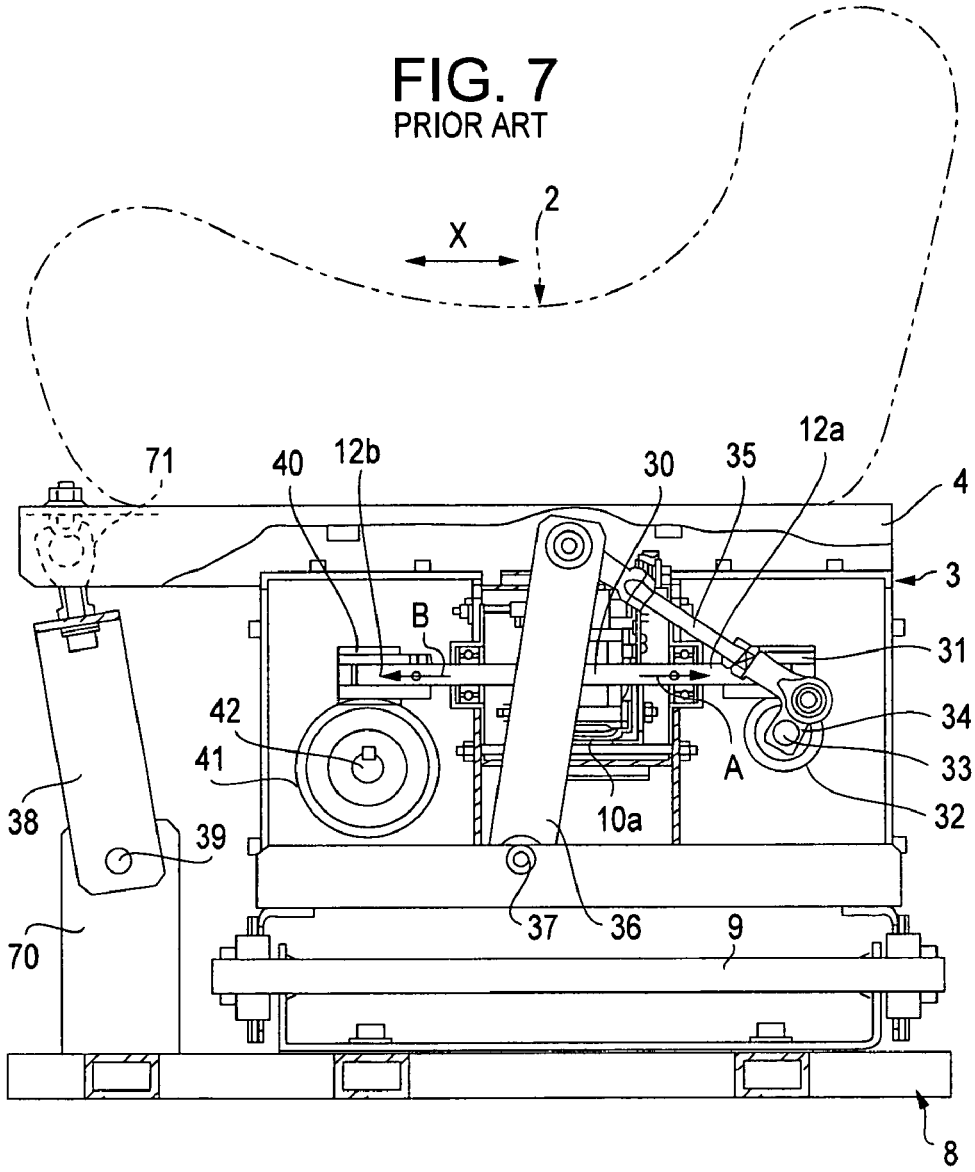
FIG. 7 PRIOR ART
FIG. 7 is a vertical cross sectional view of a conventional balance practicing machine as viewed from the right side thereof.
Figure 8:
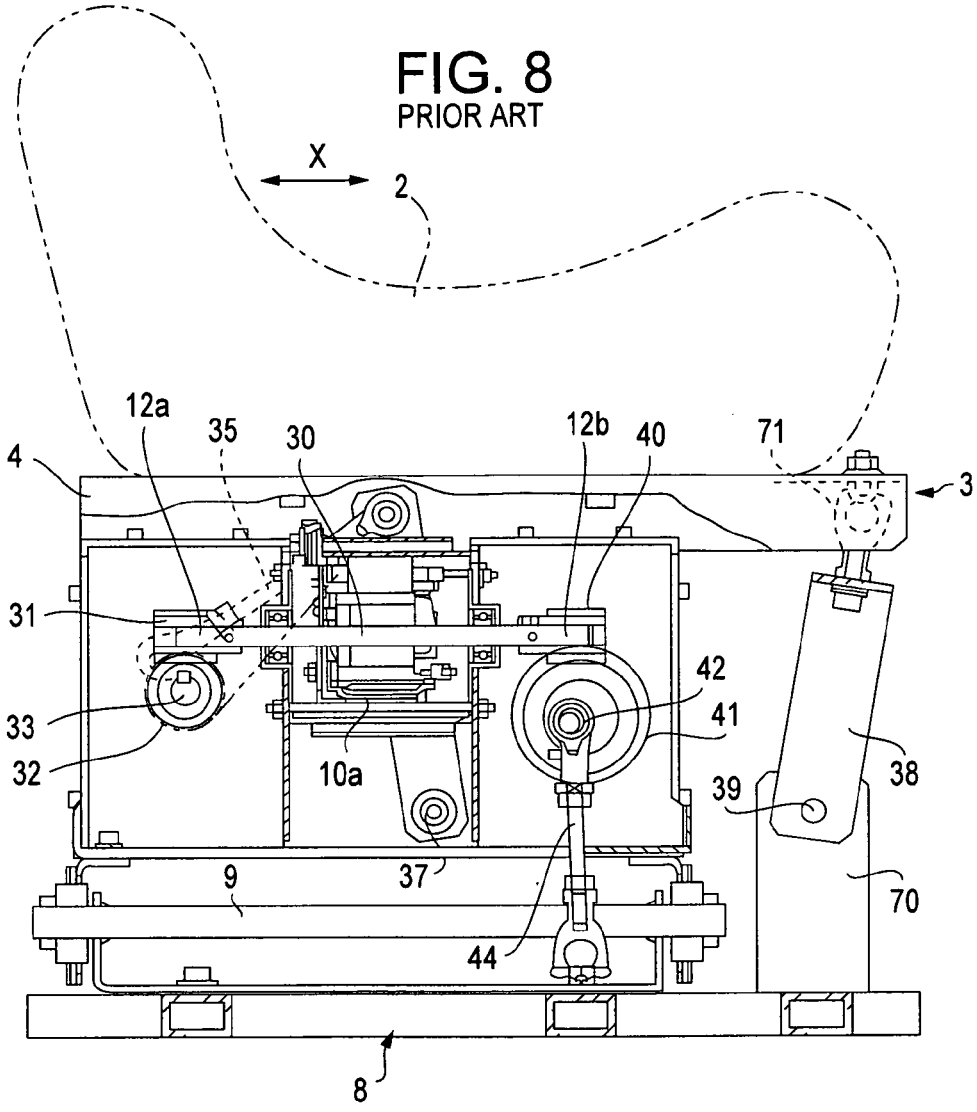
FIG. 8 PRIOR ART
FIG. 8 is a vertical cross sectional view of a conventional balance practicing machine as viewed from the left side thereof.
Figure 9:
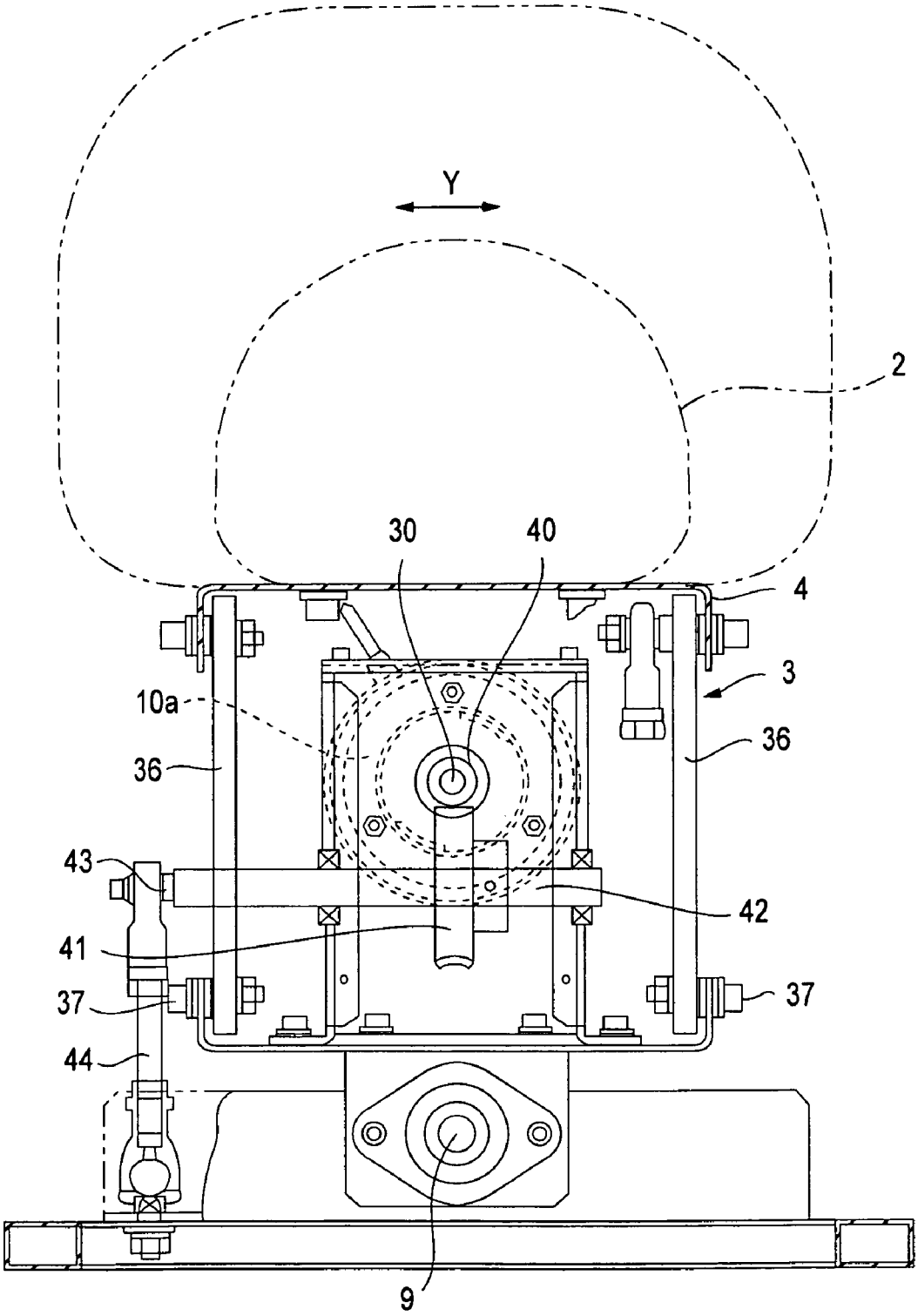
FIG. 9 PRIOR ART
FIG. 9 is a vertical cross sectional view of a conventional balance practicing machine as viewed from the front thereof.

As described above, seat 2 is driven in longitudinal X, transverse Y, and vertical Z directions, and swings in the θX and θY directions as shown in FIG. 5*b*, thus providing a balance practicing and exercise function for the person sitting thereon. Moreover, as a result of a structure that allows a single motor 10*a* to generate three movements of the seat, the balance practicing machine requires fewer motors, the control system is simplified, cost reduced, and the machine can be made to smaller dimensions. Furthermore, motor 10*a* may be installed in a vertical orientation because output shaft 12 extends from only one side of motor 10*a*. In other words, while a conventional balance practicing machine requires that motor 10*a* be disposed horizontally to accommodate output shafts 12*a* and 12*b* that extend from opposite sides of the motor (FIG. 7), the present invention provides for a single motor output shaft 12 that extends only from one side of motor 10*a*, thus allowing motor 10*a* to be positioned in a vertical orientation. As shown in FIG. 1, this configuration allows drive assembly 3, which includes motor 10*a*, to be made to smaller dimensions to occupy less space. Also, because in the present invention the drive assembly 3 can be housed within seat 2, the riding experience can be simulated more accurately than with conventional balance practicing machines. The position of the drive assembly 3 is one of the improvements of the present invention over the conventional machine of the prior art, in which the drive assembly is positioned below the seat. In the conventional machine, the position of the seat is higher that of the present invention. Accordingly, the distance between the position of the user and the position of the drive assembly 3 in the balance practicing machine of the present invention is smaller than that of the conventional machine, so that the user or target and the drive assembly 3 are closer together. This shortening of the distance between the position of the user sitting on the balance practicing machine and the drive assembly 3 results in an improvement in accuracy of the motion for balance practicing, so that the operation of the machine is easier to control.

Moreover, the number of parts required to construct the balance practicing machine of the present invention is reduced because of the structure of first sub-transmission 13*a* which includes first shaft 17, eccentric crank 19, and arm link 20; and the structure of second sub-transmission 13*b* which includes second shaft 18 and eccentric rod 21. Furthermore, first sub-transmission 13*a* can be easily assembled by simply connecting eccentric crank 19 to first shaft 17 which is rotatably supported by seat base 4, and attaching connector link 5 to eccentric crank 19 through arm link 20. Second sub-transmission 13*a* can also be easily assembled by eccentrically connecting top end 21*a* of eccentric rod 21 to second shaft 18 which is rotatably supported by seat base 4, and pivotably connecting bottom end 21*b* to base member 8. This structure provides for easy assembly while reducing the cost and size of drive assembly 3 by reducing the number of motors from three to one.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Application No. 2003-010290, filed on Jan. 17, 2003, which is herein expressly incorporated by reference in its entirety.

What is claimed is:

1. A balance practicing machine having a seat and a drive assembly that imparts a swinging motion in a longitudinal direction to the seat, said balance practicing machine comprising:

a seat base attached to the seat;

a plurality of transverse shafts provided on an active frame;

a plurality of connector links, each said connector link pivotable on one of said transverse shafts and on said seat base so as to provide swinging motion to said seat base around said transverse shafts;

a longitudinal shaft provided on a base member and pivotably supporting said active frame so as to provide a pivoting motion to said active frame around said longitudinal shaft;

an output shaft provided in said drive assembly that extends from one side of a power source; and a transmission that converts torque from said output shaft into three movements of said seat through said seat base, in the form of a linear motion in a longitudinal direction, a pivoting motion around said transverse shafts, and a pivoting motion around said longitudinal shaft.

2. The balance practicing machine according to claim 1, said transmission comprising:

a first sub-transmission that generates a linear motion in the longitudinal direction and a pivoting motion around said transverse shafts, said first sub-transmission including a first shaft rotatably supported and connected to said output shaft through a first gear, an eccentric crank eccentrically connected on one end of said first shaft, and an arm link having one end connected to said eccentric crank and another end to a connector link; and a second sub-transmission that generates a pivoting motion around said longitudinal shaft, said second sub-transmission comprising a second shaft rotatably supported and connected to said first shaft through a second gear, and an eccentric rod having a first end eccentrically connected to one end of said second shaft and a second end pivotably connected to said base member.

3. The balance practicing machine according to claim 1, said plurality of connector links comprising:

a pair of connector links comprising a first connector link pivotable on a forward transverse shaft and a second connector link pivotable on a rearward transverse shaft.

4. The balance practicing machine according to claim 3, wherein said first connector link and said second connector link are provided in positions nonparallel to each other, so that swinging motion in the longitudinal direction is imparted to said seat base.

5. The balance practicing machine according to claim 3, wherein said pair of connector links, said seat base, and said base member substantially form a trapezoid.

6. The balance practicing machine according to claim 1, wherein said drive assembly is housed substantially within said seat.

7. The balance practicing machine according to claim 1, wherein said seat base moves forwardly and rearwardly in the longitudinal direction so that said seat base is intermittently parallel and nonparallel to said base member during said swinging motion of said seat base.

8. A balance practicing machine having a seat that supports an operator, said balance practicing machine comprising:

a pedestal supporting said seat on top of said pedestal; and a drive assembly that provides a swinging motion to said seat in a first plane and a pivoting motion to said seat in a second plane that is substantially transverse to the first plane, wherein said drive assembly is housed substantially within said seat.

9. The balance practicing machine according to claim 8, wherein said seat is substantially saddle-shaped.

10. The balance practicing machine according to claim 8, said drive assembly comprising:

a pair of connector links comprising a first connector link pivotable on a forward transverse shaft and a second connector link pivotable on a rearward transverse shaft.

11. The balance practicing machine according to claim 10, wherein said first connector link and said second connector link are provided in positions nonparallel to each other, so that swinging motion in the longitudinal direction is imparted to said seat base.

12. The balance practicing machine according to claim 10, wherein said pair of connector links, a seat base, and a base member substantially form a trapezoid.

13. The balance practicing machine according to claim 12, wherein said seat base moves forwardly and rearwardly in the longitudinal direction so that said seat base is intermittently parallel and nonparallel to said base member during said swinging motion of said seat base.

14. The balance practicing machine according to claim 8, wherein the swinging motion and the pivoting motion are provided by movements about shafts which are positioned transverse to each other.

15. The balance practicing machine according to claim 8, wherein the swinging motion comprises a pivoting motion combined with a linear motion.

16. A balance practicing machine having a seat and a drive assembly that imparts a swinging motion in a longitudinal direction to the seat, said balance practicing machine comprising:

a seat base attached to the seat;

a plurality of transverse shafts provided on an active frame;

a plurality of connector links, each said connector link pivotable on one of said transverse shafts and on said seat base so as to provide swinging motion to said seat base around said transverse shafts;

a longitudinal shaft provided on a base member and pivotably supporting said active frame so as to provide a pivoting motion to said active frame around said longitudinal shaft;

a single power source; and a transmission that converts torque from said single power source into three movements of said seat through said seat base, in the form of a linear motion in a longitudinal direction, a pivoting motion around said transverse shafts, and a pivoting motion around said longitudinal shaft.

17. The balance practicing machine according to claim 16, said single power source comprising:

an output shaft provided in said drive assembly that extends from one side of said single power source;

wherein said transmission converts torque from said output shaft into said three movements of said seat through said seat base, in the form of a linear motion in a longitudinal direction, a pivoting motion around said transverse shafts, and a pivoting motion around said longitudinal shaft.

* * * * *